US007954666B2

(12) United States Patent
Webster et al.

(10) Patent No.: US 7,954,666 B2
(45) Date of Patent: Jun. 7, 2011

(54) AIRPOT AND DISPENSER LIQUID LEVEL FLOAT

(75) Inventors: Joseph P. Webster, St. Charles, MO (US); Dahyabhai Patel, Wentzville, MO (US)

(73) Assignee: Newco Enterprises, Inc., St. Charles, MO (US)

( * ) Notice: Subject to any disclaimer, the term of this patent is extended or adjusted under 35 U.S.C. 154(b) by 490 days.

(21) Appl. No.: 12/154,764

(22) Filed: May 27, 2008

(65) Prior Publication Data

US 2009/0127284 A1 May 21, 2009

Related U.S. Application Data

(60) Provisional application No. 60/936,364, filed on Jun. 20, 2007.

(51) Int. Cl.
*B67D 7/22* (2010.01)

(52) U.S. Cl. ..... 222/51; 222/156; 99/285

(58) Field of Classification Search ..... 222/51, 222/131, 183, 321.7, 475.1, 605, 154–159; 99/289 R, 304, 285, 247; 220/592.16, 592.17, 220/592.18

See application file for complete search history.

(56) References Cited

U.S. PATENT DOCUMENTS

| | | | | |
|---|---|---|---|---|
| 1,819,279 | A | 8/1931 | Coyle | |
| 2,096,848 | A | 10/1937 | Fleix | |
| 2,562,010 | A | 7/1951 | Aitken | |
| 2,682,970 | A | 7/1954 | Brothers, Jr. | |
| 3,018,025 | A | 1/1962 | Wynn | |
| 3,716,169 | A | 2/1973 | Chivers | |
| 4,129,039 | A * | 12/1978 | Pignato | 73/310 |
| 4,290,537 | A * | 9/1981 | Chi-Jung | 222/25 |
| 4,359,174 | A * | 11/1982 | Ikunosuke et al. | 222/131 |
| 4,482,083 | A | 11/1984 | Beck | |
| 4,646,933 | A | 3/1987 | Jurczenia | |
| 4,676,411 | A | 6/1987 | Simasaki | |
| 4,739,898 | A | 4/1988 | Brown | |
| 4,752,019 | A * | 6/1988 | Walker | 222/51 |
| 4,770,318 | A | 9/1988 | Earl | |
| 4,858,787 | A | 8/1989 | Stone | |
| 5,273,194 | A | 12/1993 | McNamara | |
| 5,653,362 | A | 8/1997 | Patel | |
| 7,163,125 | B2 * | 1/2007 | Murakami et al. | 222/51 |
| 7,798,373 | B1 * | 9/2010 | Wroblewski et al. | 222/209 |
| 2009/0031902 | A1 * | 2/2009 | White et al. | 99/289 R |

* cited by examiner

*Primary Examiner* — Lien T Ngo
(74) *Attorney, Agent, or Firm* — Paul M. Denk

(57) ABSTRACT

An airpot or dispenser liquid level float, provided for vertically shifting upon the air tubes of an airpot or other dispenser, the float incorporate a pivotally mounted indicator, for viewing through a view window of the dispenser, for furnishing and indication as to the level and amount of liquid remaining within the dispenser, during its usage and application.

9 Claims, 3 Drawing Sheets

AIRPOT AND DISPENSER LIQUID LEVEL FLOAT

CROSS REFERENCE TO RELATED APPLICATION

This non provisional patent application claims priority to the provisional patent application having Ser. No. 60/936,364, having filing date Jun. 20, 2007

BACKGROUND OF THE INVENTION

This invention relates to a beverage dispenser, and more particularly concerns an airpot that incorporates a float that indicates the current level of any beverage contained within the dispensing unit.

Numerous coffee decanters, beverage brewers, airpots, and a variety of other containers have long been available in the art and for use for the dispensing of a brewed beverage. The airpot style of dispenser, as well known in the art, includes a lever provided normally at the upper surface of the lid for the beverage container, and through a combination of tubings, pumps air into the container through the inlet tube, which affects the pressured delivery of the brewed beverage upperwardly towards a spout, for dispensing of the beverage to a cup or other vessel. These types of coffee dispensers have long been available in the art.

SUMMARY OF THE INVENTION

The current invention is concerned with the provision of an indicator float, within a coffee-dispenser, and readily allows the observance of the level of beverage contained within the dispenser, so that when the level of the beverage remaining within the dispenser is attaining a low level, it provides the server with an indication that the airpot must be replenished, with fresh coffee, or other beverage, for further dispensing.

This invention incorporates the structures of the usual airpot, which includes a container, normally incorporating a liner that is capable of holding various hot and recently brewed beverage, with the airpot incorporating air tubes where one allows the pressurized air being pumped proximate the dispenser lid to force pressurized air into the container, while the second tube effectively allows the beverage to be pumped upwardly, toward the lid, and be dispensed from the airpot spout, during usage and application.

The concept of the current invention is to provide a viewing window within the dispenser, having a relatively narrowed configuration, but extending upwardly within the structure of the dispenser, and providing a float means therein, just inwardly adjacent of the viewing window, so that the server can readily determine when the level of beverage remaining within the airpot is reaching a depletion stage, and then it is time to refresh the brewed beverage therein with a refilling.

The float means of this invention is designed and structured to ride upon one or both of the air tubes operatively associated within the dispenser, and to be elevated vertically depending upon the level of liquid contained within the airpot, during its usage. A pivotally mounted indicator extends forwardly from the sight mechanism, that mounts to the tubes, and has its own float contained therein so as to assure that the level of liquid remaining within the airpot can be readily observed as the liquid level descends, the float enters the viewing window, and can be readily seen for a visual determination as to the amount of beverage remaining within the dispensing airpot.

Thus, the combination of the viewing window, and the operatively associated float, can readily provide an accurate level indicator as to the remaining fluids contained within the airpot dispenser, at any time during its usage.

Furthermore, the float may be constructed to visually display a readily observable image, such as through its molding or painting with a florescent type material, or other bright color, so that it can be easily observed through the viewing window, during usage.

Other minor enhancement to this invention may include an optional nose cone that engagingly fits upon the pour spout of the dispenser, and can be used as an indicator for displaying the presence of decaf coffee, or other type of specialized beverage, that may be contained within the structured airpot during usage.

It is, therefore, the principal object of this invention to provide an airpot, with a level indicator, that can be see for some distance by the server, to determine when the beverage dispenser is being depleted, and needs to be replenished.

Still another object in this invention is to provide a float means within the liner of the airpot, and which can be readily observed through a viewing window, to indicate the remaining beverage contained within the dispenser.

Another object-of this-invention-to provide a-level indicator for a beverage dispenser that requires no participation on the part of the server, when determining the amount of beverage remaining within the airpot.

Another object is to provide a clipon device that may be connected to the nose cone of a pour spout, for an airpot, to indicate when a specialized beverage, such as decaf coffee, is present within the dispenser.

These and other objects may become more apparent to those skilled in the art upon review of this summary of the invention as provided herein, and upon undertaking a study of the description of its preferred embodiment, in view of the drawings.

DISCRIPTION OF THE PREFERRED EMBODIMENT

Figure 1:
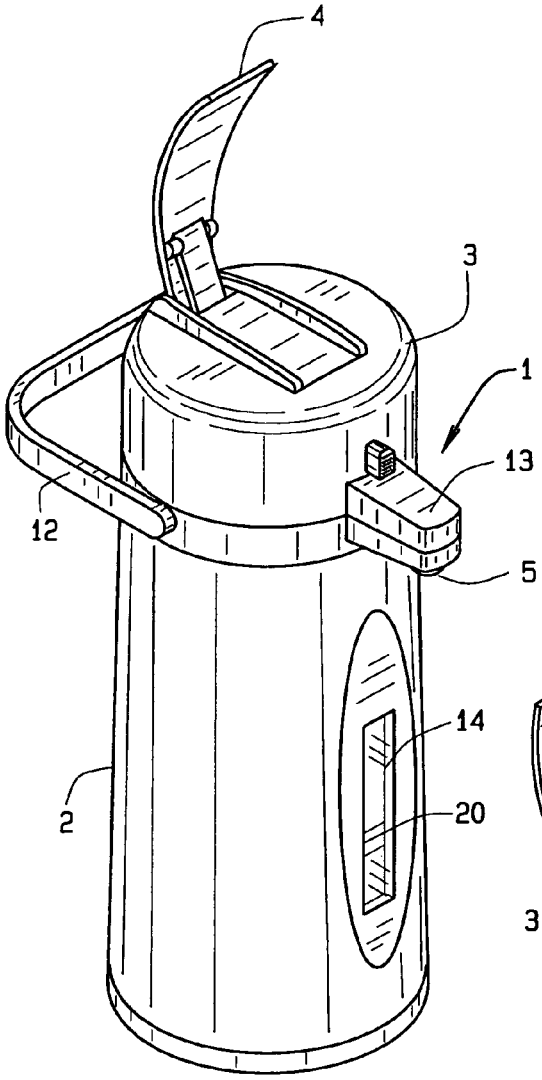
FIG. 1 is an isometric view of the dispenser of this invention.
Figure 2:
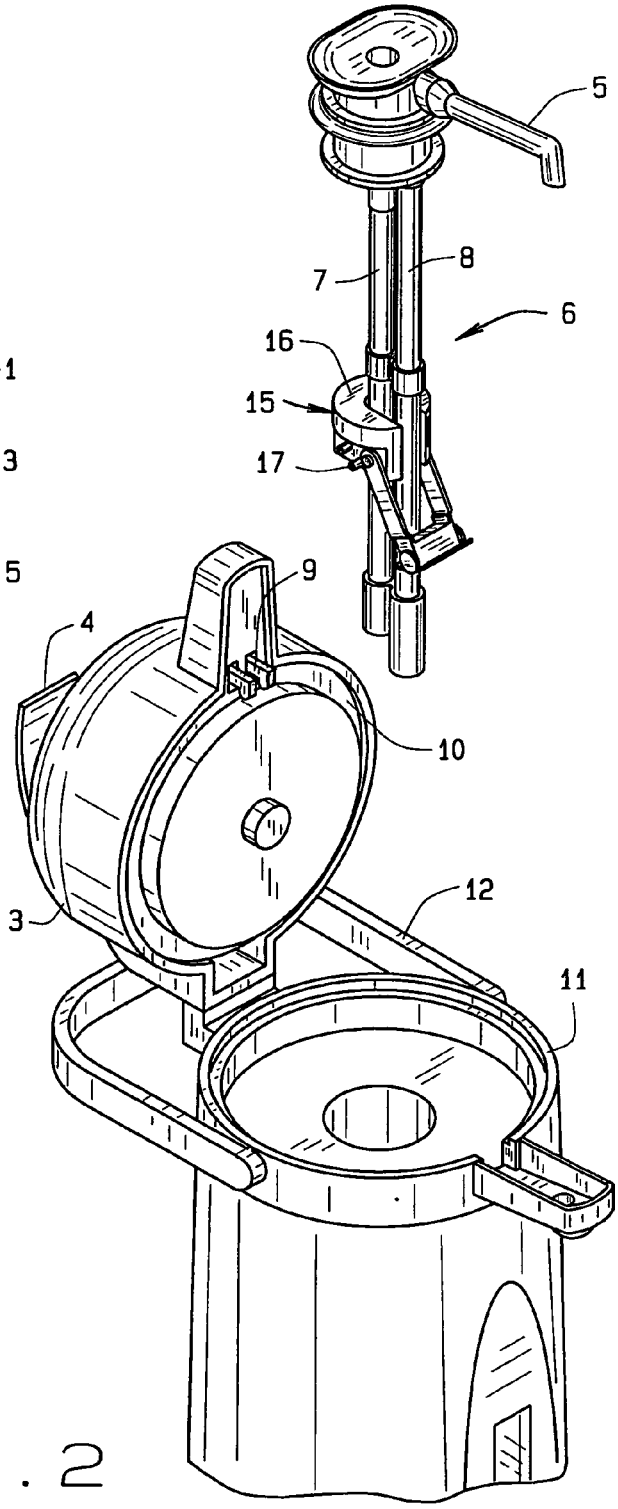
FIG. 2 is an exploded view showing the air pressure tubes, with the vertically shiftable float being applied thereto, as removed from the airpot dispenser.
Figure 3:
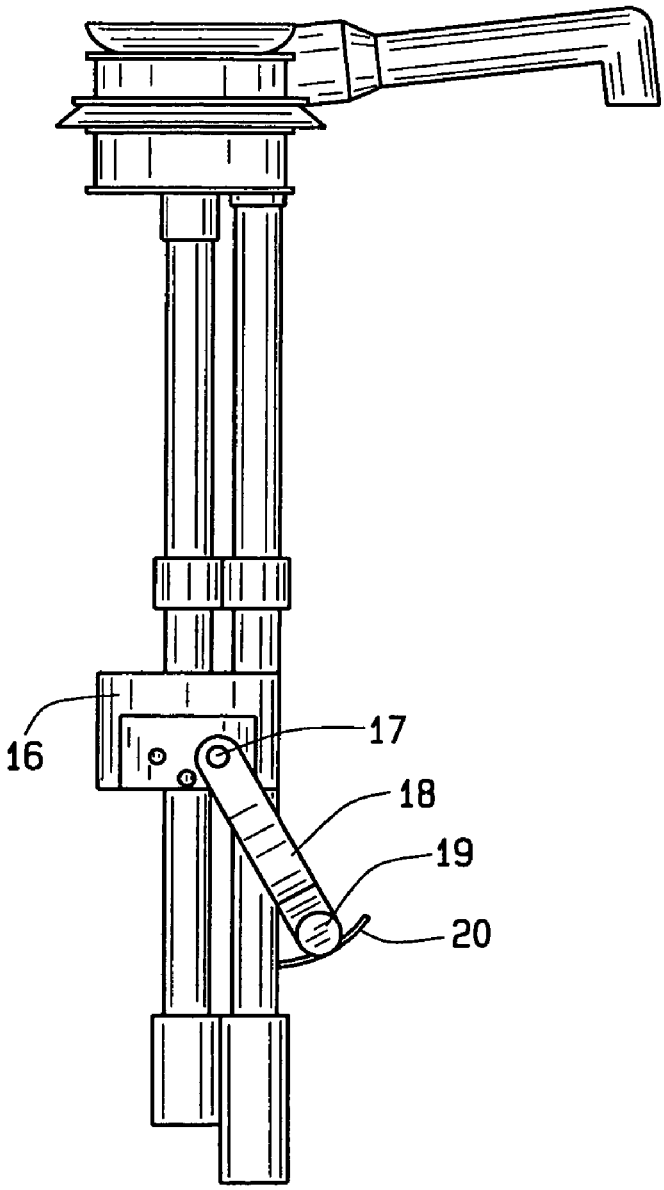
FIG. 3 shows the pair of airpot air pressure tubes, in a side view, showing the float with its pivotally mounted level indicator connected thereto.
Figure 4:
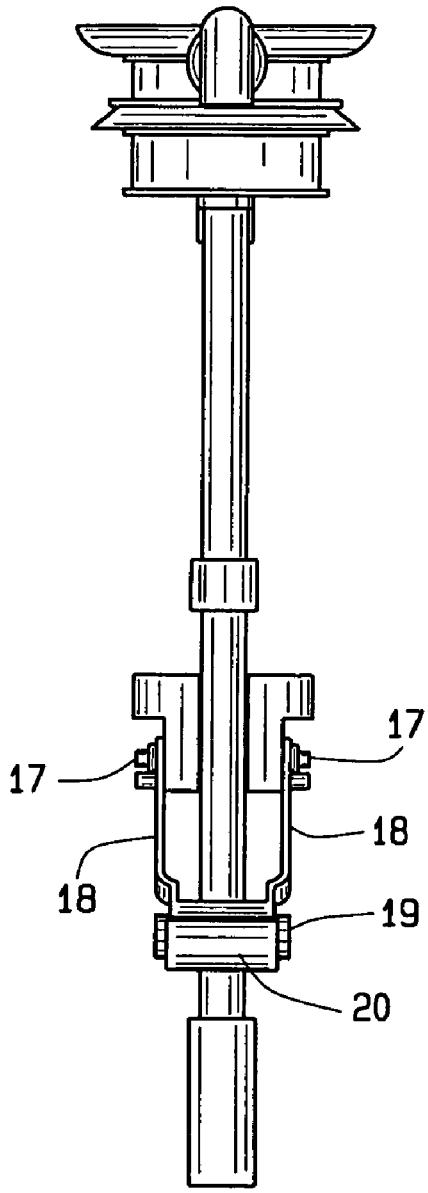
FIG. 4 is a front view of the level indicator of FIG. 3.

In referring to the drawings, and in particular FIG. 1, a beverage dispenser, in the form of an airpot 1 is disclosed. It includes its container portion 2 and has a lid 3 generally pivotally applied thereto, generally in the manner as shown in FIG. 2. While the preferred invention is described as an airpot it is just as likely that the concept of this invention, comprising a liquid level float, could be used in any type of a beverage dispenser, so as to furnish a ready indication as to the amount of beverage remaining in the dispenser, at any time.

Usually, an airpot will include a lever means 4 and a spout 5 useful for dispensing of the beverage under pressure.

As can also be seen in FIG. 2, the dispensing mechanism 6 for the airpot is readily disclosed. It includes its spout 5 that is in communication with the air tube 7 and the pressurized air intake tube 8, so that when the lever 4 is functional, and operating, and pumped, it will press air downwardly within the airline 7, while at the same time, while such air rises within the dispenser 2. to the upper level of the liquid contained therein, the brew beverage will be force up the airline 8, for discharge out of the spout 5, during application.

Furthermore, as further noted in FIG. 2, when the airpot lid 3 is pivoted into closure, and locked in place, by means of its locking mechanism, as at 9, the lid seals around its margin 10 with the upper adjacent edge 11 of the dispenser, so that pressurized air will be held intact, within the dispenser, during operations of the airpot pumping mechanism.

As can also be seen, normally with the beverage dispenser of the type as shown and describe herein, there will be some type of a handle 12 useful for the conveyance of the airpot or dispenser, and its heated beverage, during usage.

As can also be see in FIG. 1, there is what is described as a nose cone 13 that fits over the spout 5, within the structure of the shown airpot, and that nose cone generally indicates the type of beverage that may be contained in the dispenser, at any giving moment. Hence, when the nose cone is applied, it will have its own coloration or indication, or even being imprinted with the word, for example, Decaf, to indicate that decaffeinated coffee or other beverage may be contained in the airpot and its dispenser at any giving time.

With respect to the concept of this current invention, it can be see that the container 2 includes a viewing window 14, which is hermetically liquid sealed in place, in the length of surface of the shown dispenser.

Provided for cooperating with the dispenser, and for exhibiting a liquid level means for observation through the viewing window 14, is a float mechanism 15. The float mechanism is provided for vertically shifting upon the air tubes 7 and 8, and includes its integral float 16 that raises or lowers and floats upon the upper surface of any beverage remaining within the dispenser. Pivotally mounted to the pivot pins 17, one being provided to either side of the float 16, is a pivotally mounted lever mechanism 18, which has a secondary float 19 provided forwardly of the bifurcated pivotal lever mechanism 18. Appended to the front of the float 19 is an arcuate indicator 20, which generally can be viewed through the viewing window 14, so as to provide an indication as to the level of liquid contained within the dispenser, at any given time. The arcuate indicator 20 can be seen in FIG. 1, indicating that the level of the beverage contained within the shown airpot 1 may be at the approximate one-third remaining level. Thus, depending upon the level of the liquid remaining within the dispenser, the floats 16 and 19 will float on the upper surface of the remaining beverage, contained within the dispenser, so as to provide structural support for the arrangement of the arcuate indicator 20 through the viewing window, and hold the indicator in proximity just inside of the viewing window, at all times. Furthermore, the float 16 is held in position by means of the pair of air line 7 and 8, and therefore, can not pivot to the side, but rather, always holds it lever arms 18, the float 19, and its arcuate indicator 20, forwardly within the dispenser, and always Within sight of the viewing window 20, when the level of the liquid gradually decreases within the dispenser 2, and reaches the approximate one half level point, such that the arcuate indicator shows that at least under those circumstances, one-half of the container still holds some of the brewed beverage, for further dispensing. But, as the level of the liquid lowers, when additional beverage is being dispensed from the airpot, and the liquid level descends below the approximate one-half point, the float 16 will slide downwardly upon the airlines 7 and 8, and the supplemental float 19 will likewise float downwardly to sustain its flotation upon the surface of remaining beverage, and show through its arcuate indicator 20, what is the true level of the liquid remaining within the dispenser 2, indicating to the server that the beverage is beginning to be depleted, and may need to be refreshed and replenished.

Figure 5:
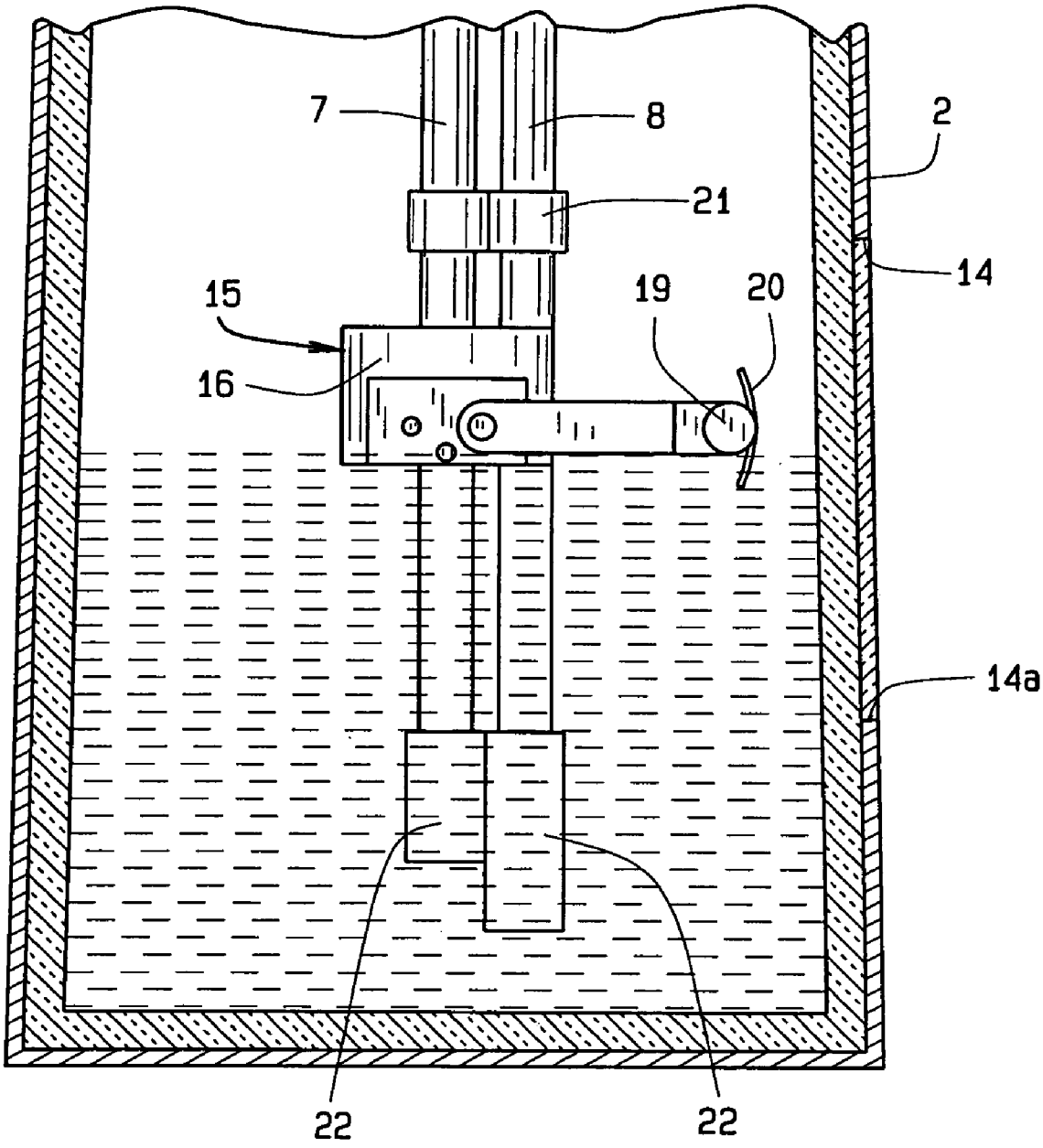
FIG. 5 show the pressure tubes of the airpot, mounted within the dispenser and indicating how the vertically shiftable and level indicator float upon the surface of the remaining beverage contained within the airpot, and how its level indicator can be observed through the viewing window of the dispenser.

The actual operation of the float 15 within the dispenser can be seen in FIG. 5, where both the float 16 remains upon the surface of the beverage remaining within the dispenser, and likewise, the supplemental float 19 holds the arcuate indicator 20 just behind the viewing window 14, as can be seen.

Furthermore, the limits of movement of the float can be controlled through the use of stops 21 that are resiliently applied to the air tubes 7 and 8, while the lower stops 22 provide a lower limit for descend of the float 15, within the beverage dispenser. Hence, when the float reaches the upper level of flotation, in the vicinity of the upper stop 21, its arcuate indicator will generally be in line with the upper edge of the view window 14. But, when the beverage is dispensed from the device, and the float descends, by the time it reaches the lower stops 22, its indicator will be within the vicinity of the lower edge of the window, as noted at 14*a*, indicating that very little beverage remains, and needs to be refilled or replenished. These stops may be shiftable upon the air tubes.

There may also be provided adjacent the view window 14, some indicia indicating the amount of liquid and beverage that may remain within the dispenser. For example, at the upper end of the window, as at 14, it may indicate that the dispenser yet contains approximately one half of the volume of the beverage that can be contained in the dispenser when full. Likewise, when the arcuate indicator reaches the lower end of the view window 14*a*, there may be indicia applied adjacent thereof to indicate that there may only be one-fifth of the beverage remaining within the dispenser, indicating that it may need to be replenished.

Variations or modifications to the subject matter of this invention may occur to those skilled in the art upon review of the development as provided herein. Such variations, if with the spirit of this development, are intended to be encompassed within the scope of the invention as defined. The depiction of the invention, as shown in the drawings, are generally set forth for illustrative purposes only.

We claim:

1. An airpot or other dispenser for a beverage incorporating a liquid level indicator, said dispenser having a container, a lid applied to the container, at least one air tube extending downwardly within the container to provide for flowing of beverage to and through a spout during dispensing, said container having a view window provided through its approximate front wall, a float operatively mounted for vertical shifting upon the at least one air tube therein, said float having an indicator extending forwardly therefrom, so that said float and indicator will float upon the surface of any beverage remaining within the dispenser, said indicator provided for selective viewing through the view window to provide an indication as to the amount of beverage remaining within the dispenser during usage, said float slidably mounts upon the at least one air tube within the container, at least one arm extending from the float and connecting with the indicator, with said float and indicator capable of moving with the surface of any liquid remaining within the container to provide an indication through its view window of the amount of beverage remaining within the airpot during usage.

2. The airport of claim 1 wherein said container includes said spout that provides for flowing of the beverage out of the airpot during dispensing, said spout having an upper surface, and said upper surface incorporating indicia to indicate the type of beverage contained within the container during usage.

3. The airpot of claim 2 and including said lever mechanism pivotally mounting proximate to the float, and attaching with the indicator at its other end, and capable of pivoting with respect to the float to locate the indicator within proximity of the view window to provide an indication as to the amount of beverage remaining within the container during usage.

4. The airpot of claim 3 and including a second float connecting with the indicator, at the approximate end of the lever mechanism, so that the second float also floats upon the surface of any beverage remaining within the container, and remains reasonably level with the said first float as it vertically shifts upon the air tube during usage.

5. The airpot of claim 4 and including indicia provided upon the view window of the container to indicate the amount of beverage remaining within the airpot during its dispensing.

6. The airpot of claim 5 wherein a pair of air tubes locate within the dispenser, and said first float embracing said air tubes during its vertical shifting while floating upon the surface of any beverage remaining in the container during usage.

7. The airpot of claim 6 wherein said indicator is arcuate, maintaining a convex surface in proximity with the interior of the view window, during its flotation upon the surface of any liquid remaining within the dispenser during usage.

8. The airpot of claim 7 and including an upper stop adjustably applied to the at least one air tube, to provide an upper limit to the elevation of the first float within the container during usage.

9. The airpot of claim 8 and including a lower stop, adjustably mounted to the at least one air tube, and providing a lower limit to the vertical shifting of the float and indicator during application of the dispenser for dispensing of a beverage during usage.

* * * * *